US012359555B2

(12) United States Patent
Lu et al.

(10) Patent No.: US 12,359,555 B2
(45) Date of Patent: Jul. 15, 2025

(54) SUBSEA WELLHEAD SYSTEM FATIGUE DAMAGE MONITORING

(71) Applicant: Chevron U.S.A. Inc., San Ramon, CA (US)

(72) Inventors: Wangming Lu, Katy, TX (US); William Penaloza, The Woodlands, TX (US); Brian Koons, Huntsville, TX (US); Thomas Chase, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 338 days.

(21) Appl. No.: 17/822,869

(22) Filed: Aug. 29, 2022

(65) Prior Publication Data

US 2024/0068356 A1 Feb. 29, 2024

(51) Int. Cl.

| | |
|---|---|
| ***E21B 47/007*** | (2012.01) |
| *E21B 33/035* | (2006.01) |
| *E21B 47/001* | (2012.01) |

(52) U.S. Cl.

CPC ..... *E21B 47/007* (2020.05); *E21B 33/035* (2013.01); *E21B 47/001* (2020.05)

(58) Field of Classification Search

CPC ..... E21B 47/007; E21B 47/001; E21B 33/035
See application file for complete search history.

(56) References Cited

U.S. PATENT DOCUMENTS

| | | | | |
|---|---|---|---|---|
| 8,652,041 | B2 * | 2/2014 | Moore-Ede | B60K 28/06 600/300 |
| 9,528,322 | B2 * | 12/2016 | MacDonald | E21B 36/04 |
| 2015/0204167 | A1 * | 7/2015 | Skeels | E21B 49/001 166/344 |
| 2020/0199996 | A1 | 6/2020 | Lu et al. | |

OTHER PUBLICATIONS

Mercan, Bulent, et al., Soil Model Assessment for Subsea Wellhead Fatigue Using Monitoring Data, OTC-27662-MS, May 1-4, 2017.

* cited by examiner

*Primary Examiner* — Elias Desta
(74) *Attorney, Agent, or Firm* — King & Spalding LLP

(57) ABSTRACT

A computing system, method, and computer-readable medium includes a fatigue tracking service that assists with monitoring fatigue damage in a subsea wellhead system. The fatigue tracking service uses historical environmental data to determine a fatigue damage rate. The fatigue tracking service determines a fatigue allowance based upon the fatigue damage rate, a number of days assigned to a well operation, and a total allowable fatigue damage. The fatigue tracking service compares the fatigue allowance to measurements providing an accumulated fatigue damage to facilitate the monitoring of fatigue damage in the subsea wellhead system.

20 Claims, 7 Drawing Sheets

Well Construction Timing Estimate

Fatigue Damage Allowance Calculated

Operation Timing

| Activity | P90 | | | | | Fatigue Damage Allowance (Total: 70%) | | |
|---|---|---|---|---|---|---|---|---|
| | Days | Cumul. Days | % Days | Cumul. % Days | | Estimated | Cumul. | |
| BOP | 20.6 | 20.6 | 3.51% | 3.51% | | 0.83% | 0.83% | |
| 18" section | 14.4 | 35.0 | 2.45% | 5.96% | | 0.58% | 1.40% | |
| 16" section | 26.4 | 61.4 | 4.50% | 10.46% | | 1.06% | 2.46% | |
| 14" section | 26.5 | 87.9 | 4.57% | 14.97% | | 1.06% | 3.53% | |
| 11-7/8" section | 24.4 | 112.3 | 4.16% | 19.13% | | 0.38% | 4.50% | |
| 10.05" section + logs + S/T | 41.6 | 153.9 | 7.09% | 26.21% | | 1.67% | 6.17% | |
| Prod Tub + suspension | 33.1 | 187.0 | 5.64% | 31.85% | | 1.33% | 7.50% | |
| Total Drilling | 187.0 | | 31.85% | | | 7.50% | | |
| | | | | | | | | |
| Total Completion + S/T | 376.9 | | 64.20% | | | 60.00% | | |
| Intervention Oper. (e.g., CWOR) | 23.2 | | 3.95% | | | 2.50% | | |
| Total Well Life | 587.1 | | 100.00% | | | 70.00% | | |

Drilling Phases

FIG. 5

From Fatigue Analysis

| Daily Fatigue Damage Rate (%) | | P90 | Total Damage (%) | | Total Fatigue Allowance | 70.00% |
|---|---|---|---|---|---|---|
| on drilling | 0.005% | 187.0 | 1.01% | | on drilling | 7.50% |
| on completion | 0.083% | 376.9 | 31.28% | | on completion | 60.00% |
| on intervention (e.g., CWOR) | 0.000% | 23.2 | 0.00% | | on intervention (e.g., CWOR) | 2.50% |

FIG. 6

| Real Time Day of Analysis | Total days | 7' AML daily damage (%) | Accumulated damage (%) | |
|---|---|---|---|---|
| 12/24/2021 | 20.6 | 0.002% | 0.002% | |
| 12/25/2021 | 21.6 | 0.001% | 0.002% | |
| 12/26/2021 | 22.6 | 0.000% | 0.002% | |
| 12/27/2021 | 23.6 | 0.001% | 0.004% | |
| 12/28/2021 | 24.6 | 0.008% | 0.012% | |
| 12/29/2021 | 25.6 | 0.008% | 0.020% | |
| 12/30/2021 | 26.6 | 0.030% | 0.050% | |
| 12/31/2021 | 27.6 | 0.016% | 0.066% | |
| 1/1/2022 | 28.6 | 0.011% | 0.077% | |
| 1/2/2022 | 29.6 | 0.010% | 0.087% | |
| 1/3/2022 | 30.6 | 0.021% | 0.108% | |
| 1/4/2022 | 31.6 | 0.035% | 0.143% | |
| 1/5/2022 | 32.6 | 0.024% | 0.167% | End of 18" section |
| 1/6/2022 | 33.6 | 0.000% | 0.167% | Start of 16" section |

Measured Fatigue Damage

FIG. 7

SUBSEA WELLHEAD SYSTEM FATIGUE DAMAGE MONITORING

TECHNICAL FIELD

Embodiments of the technology relate generally to tracking fatigue damage in subsea wellhead systems.

BACKGROUND

Offshore production of hydrocarbons requires drilling and completing wells in addition to interventions for ultimately abandoning the wells at the end of the well life cycle, which is often over 30 years. The offshore wells are sometimes located in challenging deepwater environments, requiring highly specialized subsea equipment for ensuring the well construction operation and production is carried out safely. The foundation of a subsea well is the wellhead system, which is installed during the first phase of drilling operations to provide pressure containment and structural support for the extreme loads derivate from installing temporary drilling and intervention equipment (i.e., subsea blow-out preventer stack) and permanent equipment (i.e., casing, tubing head spools, production trees). The subsea wellhead system typically includes the low-pressure housing installed with the jetted conductor casing and the high-pressure housing installed with the surface casing, locked into the low-pressure housing, typically located at 10-15 feet above the sea floor. Next, a riser extending from the floating platform is connected to the wellhead system and the remainder of the well is drilled with casing strings landed either directly on the high-pressure housing or on sub-mudline hangers. The wellhead system will support the weight of the heavy subsea blow-out preventers installed directly on the high-pressure housing for drilling operations or either the tubing head spool or production tree for completions and intervention operations. For a typical deepwater subsea well, the blow-out preventer stack may be as heavy as 700 tons with heights over 50 feet, depending on the configuration. On top of the blow-out preventers stack, long subsea riser equipment extending upward from the wellhead system is installed as conduit for the fluids used for the operation in the well. The length of the subsea riser varies depending on the water depth, with lengths exceeding 5,000 feet above the blow-out preventer stack for deepwater wells. The subsea riser is subjected to forces from ocean currents, waves, and loading from surface vessels. The variation of the forces on the riser equipment causes stress cycles on the wellhead system, leading to fatigue damage on the wellhead system. Other sources of stress cycles on the wellhead system can include vibration of the equipment connected to the subsea wellhead system such as flowlines used during production. Furthermore, pressure and temperature cycles on the wellhead system can cause stress cycles and subsequent fatigue damage on the wellhead system. Wellhead system fatigue damage can accumulate and negatively impact the remaining useful life of the wellhead system and the well. Therefore, techniques for monitoring wellhead system fatigue would benefit the operation of subsea wells.

SUMMARY

The present disclosure is generally directed to monitoring fatigue damage to a subsea wellhead system. In one example embodiment, a computing system comprises a processor, a memory, and a storage device comprising a fatigue tracking service comprising computer-executable instructions that perform a method. The method of the fatigue tracking service comprises determining, using historical environmental data, a fatigue damage rate for a wellhead system, the fatigue damage rate comprising a drilling fatigue damage rate for a drilling operation and a completion fatigue damage rate for a completion operation. The method further comprises receiving a total maximum allowable fatigue damage for the wellhead system during its entire life cycle and assigning a number of drilling days for the drilling operation and a number of completion days for the completion operation, and number of days for other operations if applicable. The method includes determining a drilling fatigue allowance and a completion fatigue allowance based upon the drilling fatigue damage rate, the completion fatigue damage rate, the total maximum allowable fatigue damage, the number of drilling days, and the number of completion days. Lastly, the method includes determining an accumulated amount of fatigue damage for the wellhead system during actual offshore operations such as drilling, completion and intervention; and providing a comparison of the accumulated fatigue damage to the determined fatigue allowance for specific operations such as drilling, completion and intervention.

Another example embodiment is a computer-implemented method for monitoring fatigue damage to a wellhead. The method comprises determining, by a fatigue tracking service using historical environmental data, a fatigue damage rate for a wellhead system, the fatigue damage rate comprising a drilling fatigue damage rate for a drilling operation and a completion fatigue damage rate for a completion operation. The method further comprises receiving a total maximum allowable fatigue damage for the wellhead system and assigning a number of drilling days for the drilling operation and a number of completion days for the completion operation. The method includes determining a drilling fatigue allowance and a completion fatigue allowance based upon the drilling fatigue damage rate, the completion fatigue damage rate, the total maximum allowable fatigue damage, the number of drilling days, and the number of completion days. Lastly, the method includes determining an accumulated fatigue damage for the wellhead system based upon at least one of drilling fatigue damage measurements for the wellhead system and completion fatigue damage measurements for the wellhead system; and providing a comparison of the accumulated fatigue damage to at least one of the drilling fatigue allowance and the completion fatigue allowance.

In yet another example embodiment, a non-transitory computer-readable medium comprises computer-executable instructions that when executed by a hardware processor perform a method. The method comprises determining, by a fatigue tracking service using historical environmental data, a fatigue damage rate for a wellhead system, the fatigue damage rate comprising a drilling fatigue damage rate for a drilling operation and a completion fatigue damage rate for a completion operation. The method further comprises receiving a total maximum allowable fatigue damage for the wellhead system and assigning a number of drilling days for the drilling operation and a number of completion days for the completion operation. The method includes determining a drilling fatigue allowance and a completion fatigue allowance based upon the drilling fatigue damage rate, the completion fatigue damage rate, the total maximum allowable fatigue damage, the number of drilling days, and the number of completion days. Lastly, the method includes determining an accumulated fatigue damage for the wellhead system based upon at least one of drilling fatigue damage measurements for the wellhead system and completion fatigue damage measurements for the wellhead system; and providing a comparison of the accumulated fatigue damage to at least one of the drilling fatigue allowance and the completion fatigue allowance.

The foregoing embodiments are non-limiting examples and other aspects and embodiments will be described herein. The foregoing summary is provided to introduce various concepts in a simplified form that are further described below in the detailed description. This summary is not intended to identify required or essential features of the claimed subject matter nor is the summary intended to limit the scope of the claimed subject matter.

BRIEF DESCRIPTION OF THE DRAWINGS

The accompanying drawings illustrate only example embodiments of a system, method, and computer-readable media for monitoring fatigue damage to subsea wellhead systems. Therefore, the examples provided are not to be considered limiting of the scope of this disclosure. The principles illustrated in the example embodiments of the drawings can be applied to alternate methods and apparatus. Additionally, the elements and features shown in the drawings are not necessarily to scale, emphasis instead being placed upon clearly illustrating the principles of the example embodiments. Certain dimensions or positions may be exaggerated to help visually convey such principles. In the drawings, the same reference numerals used in different embodiments designate like or corresponding, but not necessarily identical, elements.

FIGS. 5 and 6 provide representative data used in connection with determining allowable fatigue damage in accordance with an example embodiment of the disclosure.

FIG. 7 provides representative measured fatigue damage data in accordance with an example embodiment of the disclosure.

DETAILED DESCRIPTION OF EXAMPLE EMBODIMENTS

Figure 1:
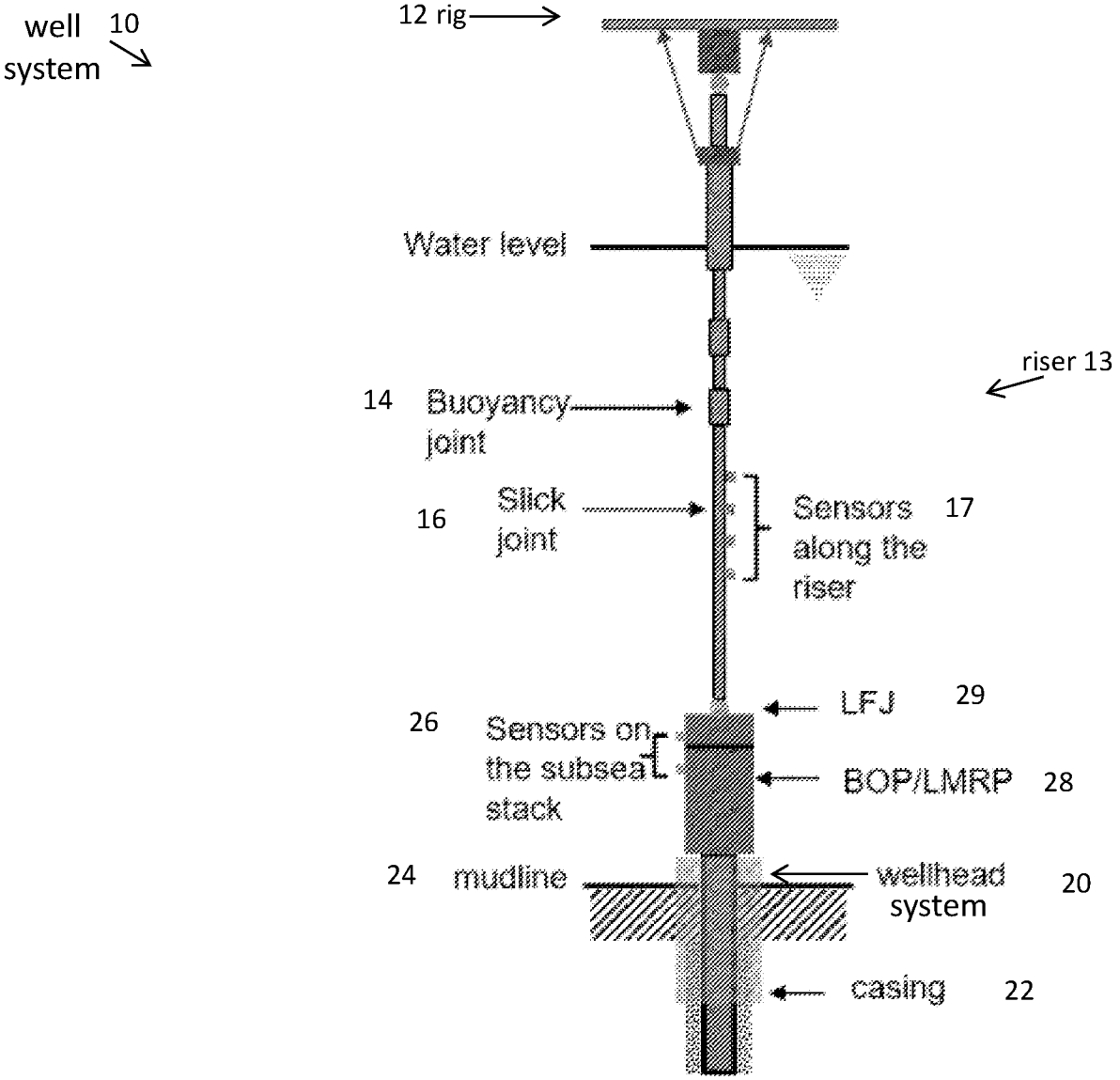
FIG. 1 illustrates an example subsea well system in accordance with an example embodiment of the disclosure.

The example embodiments discussed herein are directed to systems, methods, and computer-readable media for monitoring fatigue damage on subsea wellhead systems. Existing approaches to managing wellhead fatigue damage rely on estimates of the amount of fatigue damage that may occur at the wellhead. However, because the estimates are highly variable and uncertain, with uncertainty exceeding one order of magnitude in some cases, overly conservative assumptions must be used in fatigue analysis. The overly conservative assumptions lead to conservative estimates of the amount of fatigue damage on the wellhead system. The amount of fatigue damage on the wellhead system can affect planning for the rig at the surface, planning with respect to various operations performed on the well, and planning with respect to the operational life of the well. Using overly conservative estimates of the amount of fatigue damage in managing the well operations can result in unnecessary downtime, such as waiting for a weather system to pass before performing an operation on the well, and the performance of unnecessary operations, such as disconnecting the riser or BOP from the well, and such operations can result in unnecessary added complications and risks. Overly conservative estimates of the amount of fatigue damage on a wellhead system also can unnecessarily shorten the operational life of the well. Given the complexity of drilling and operating a subsea well, unnecessary downtime and unnecessary limiting of the life of the well can add operational risk, loss of recoverable reserves and result in substantial expense. Accordingly, more accurate techniques for monitoring wellhead fatigue damage allows for better planning decisions regarding the well, including improved operational safety and more flexibility and efficiency in the operation of the well.

The techniques described in the following example embodiments employ a more detailed analysis of fatigue damage by analyzing the drilling operations, the completion operations, and intervention operations. Furthermore, the techniques described herein can use a more granular approach because they also can analyze the phases within the foregoing operations. Another advantage of the techniques described herein is that they can modify fatigue damage allowances as measured fatigue damage data becomes available thereby providing flexibility in the operation of the well.

While the example embodiments for performing wellhead system monitoring are provided in the descriptions that follow, modifications to the embodiments described herein are within the scope of this disclosure. In the following paragraphs, particular embodiments will be described in further detail by way of example with reference to the drawings. In the description, well-known components, methods, and/or processing techniques are omitted or briefly described. Furthermore, reference to various feature(s) of the embodiments is not to suggest that all embodiments must include the referenced feature(s).

Referring now to FIG. 1, an example subsea well system 10 for a drilling stack-up is illustrated. As will be described further, "well system" is used herein broadly to include the wellhead housings, casings, production tubing, the blowout preventer with lower marine riser package, the riser system and other equipment typically used in connection with a subsea well. The fatigue damage tracking techniques described herein can be applied to subsea well system 10 and other types of well systems. The components of the well system 10 illustrated in FIG. 1 are examples and the fatigue monitoring techniques described herein can be used with other well systems that can have an arrangement of components different from example well system 10.

As illustrated in FIG. 1, a rig 12 is positioned on the surface of the sea, which is indicated by the water level and the rig floor and riser tensioning system are positioned above the water level. A well in the sub-mudline formation is lined with a casing 22 and attached to a wellhead system 20. The wellhead system 20 can comprise a high pressure wellhead housing, a low pressure wellhead housing, conductor casing and its connections, surface casing and its connections, and for some wells, a supplemental adapter joint between the low pressure housing and conductor casing, a heavy wall extension joint between the high pressure housing and surface casing, and another casing and its connections between the conductor casing and the surface casing. In some applications of the methods described herein, the wellhead system can include other equipment used in contingency scenarios such as a wellhead extension. When monitoring fatigue damage for the wellhead system 20, there can be a number of locations of interest, also known as hot spots, along the components of the wellhead system. In some applications of the embodiments disclosed herein, multiple locations along the components of the wellhead system 20 can be pre-assessed and those locations of highest risk of fatigue damage can be monitored. Accordingly, when referenced herein, the "wellhead system" can include any of the locations along the components of a wellhead system. The wellhead system 20 is positioned over the well at the seafloor or mudline 24. FIG. 1 illustrates several components of the well system 10 that are located between the rig 12 and the wellhead system 20. A riser 13 extends from the rig 12 toward the wellhead system 20. The riser 13 can comprise a buoyancy joint 14 located near the top of the well system 10 that can assist in maintaining the stability of the well system 10. The riser can further comprise a slick joint 16. A lower flexible joint 29 can couple the riser 13 to the wellhead system 20 via a blowout preventer/lower marine riser package 28. The blowout preventer/lower marine riser package 28 can be a large valve or similar device that is used to seal off, control, and monitor the well to prevent uncontrolled release of fluids from the well.

As illustrated in FIG. 1, a variety of sensors can be located along the well system that can be used to gather information about the stresses exerted on the wellhead system 20. Sensors 17, such as accelerometers and strain gauges, can be located along the slick joint to measure the movements of the riser, including horizontal and vertical displacement as well as inclination angle from the vertical axis. As explained previously, the movement of the riser can be caused by currents in the water, waves, forces from the rig 12, and/or forces from the seafloor. Similarly, sensors 26, such as accelerometers and an inclinometer, on the subsea stack can measure horizontal and vertical displacement of the subsea stack, inclination angle, and acceleration, among other parameters. Measuring the movements of the riser 13 and the subsea stack provide a measure of the stresses exerted on the wellhead system 20. As will be described further below, this measurement data can be used to calculate the amount of fatigue damage on the wellhead system which will then be compared to the fatigue damage allowance for the wellhead system for purposes of monitoring wellhead system fatigue.

Figure 2:
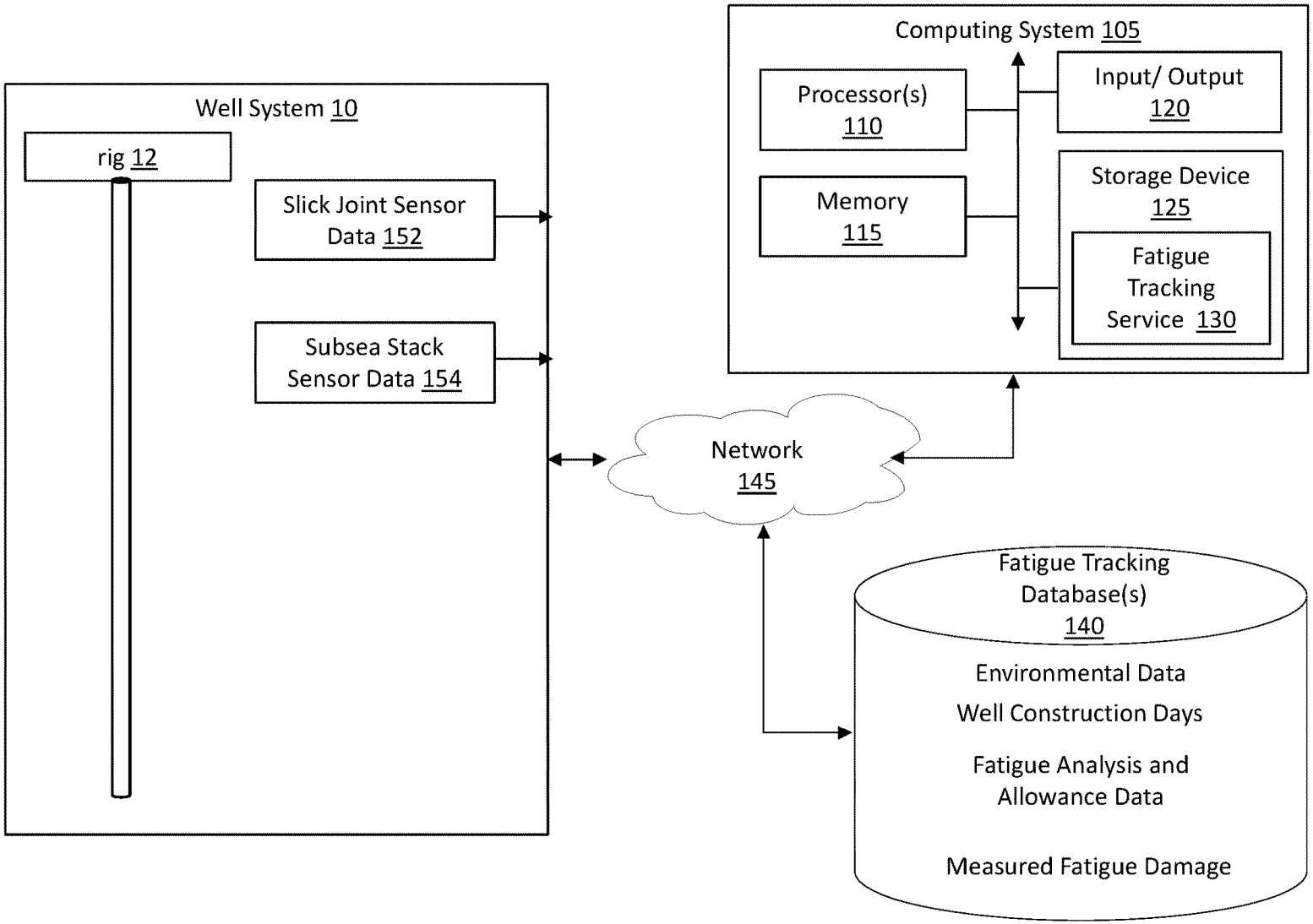
FIG. 2 illustrates an example computing system for monitoring wellhead fatigue damage in accordance with an example embodiment of the disclosure.

Referring now to FIG. 2, a system is illustrated for monitoring wellhead system fatigue. FIG. 2 shows the previously described well system 10 in simplified form and illustrates the availability of the measured slick joint sensor data 152 and the measured subsea stack sensor data 154. In other embodiments, different or additional sensor data may be available from the well system. The sensor data is communicated via network 145 for use by computing system 105. The sensor data also can be used to calculate the amount of fatigue damage on the wellhead system, which can then be stored as measured fatigue damage data in fatigue tracking database 140. FIG. 2 additionally illustrates other types of data that can be stored in fatigue tracking database 140. The database 140 can include fatigue analysis data which can comprise historical estimated fatigue damage rates on the wellhead system using the historical environmental data for various operations to be performed on the well. The database 140 also can include data concerning well construction days that indicates the amount of time that will be spent on each operation performed on the well. The well construction days and the estimated wellhead system fatigue damage rate can be used to determine an amount of fatigue damage the wellhead system is likely to incur over the life of the wellhead system. The estimated amount of fatigue damage can be used to calculate a fatigue damage allowance for each operation of the well. Lastly, analysis data comparing the fatigue damage allowance with the measured amount of fatigue damage can be stored in the database 140. The analysis data can include reports of the comparison and recommendations for improving the management of the operations performed on the well.

As is commonly known for computing systems, computing system 105 includes one or more processors 110, memory 115, and input/output interfaces 120. The storage device 125 can be an integrated component of the computing system 105, as illustrated in FIG. 2, or it can be external to the computing system. In addition to an operating system, the storage device can include a fatigue tracking service ("FTS") 130. The FTS 130 can receive data from the fatigue tracking database 140 via network 145 and analyze the data to provide recommendations for optimizing the monitoring of wellhead system fatigue damage. The FTS includes computer executable instructions that perform methods for estimating wellhead system fatigue damage rates, calculating a wellhead system fatigue damage allowance, and comparing the wellhead system fatigue damage allowance to the measured amount of fatigue damage based on measured fatigue damage rates collected from the well system.

The computing components illustrated in FIG. 2 are merely illustrative examples and that in alternate embodiments certain of the computing components can be combined, simplified, or distributed in a different manner. While the FTS 130 is illustrated in FIG. 2 as one or more software modules stored in storage device 125 of computing system 105, the FTS 130 also can be implemented as a service available on remote computing devices, such as the cloud, which service can be accessed to analyze wellhead system fatigue damage data and provide recommendations for managing the operation of the well. Additionally, while the FTS 130 is described herein as an integrated software service, in other embodiments the service can be distributed across multiple services or computing systems. Furthermore, in certain embodiments the FTS 130 can include a machine learning model that is trained using historical measured fatigue damage data for the wellhead system to estimate fatigue damage rates during actual well operations, thus replacing the physical system that measures the fatigue damage rate of the wellhead system. The operation of the FTS 130 will be described in further detail below in connection with the example methods of FIGS. 3 and 4.

Figure 3:
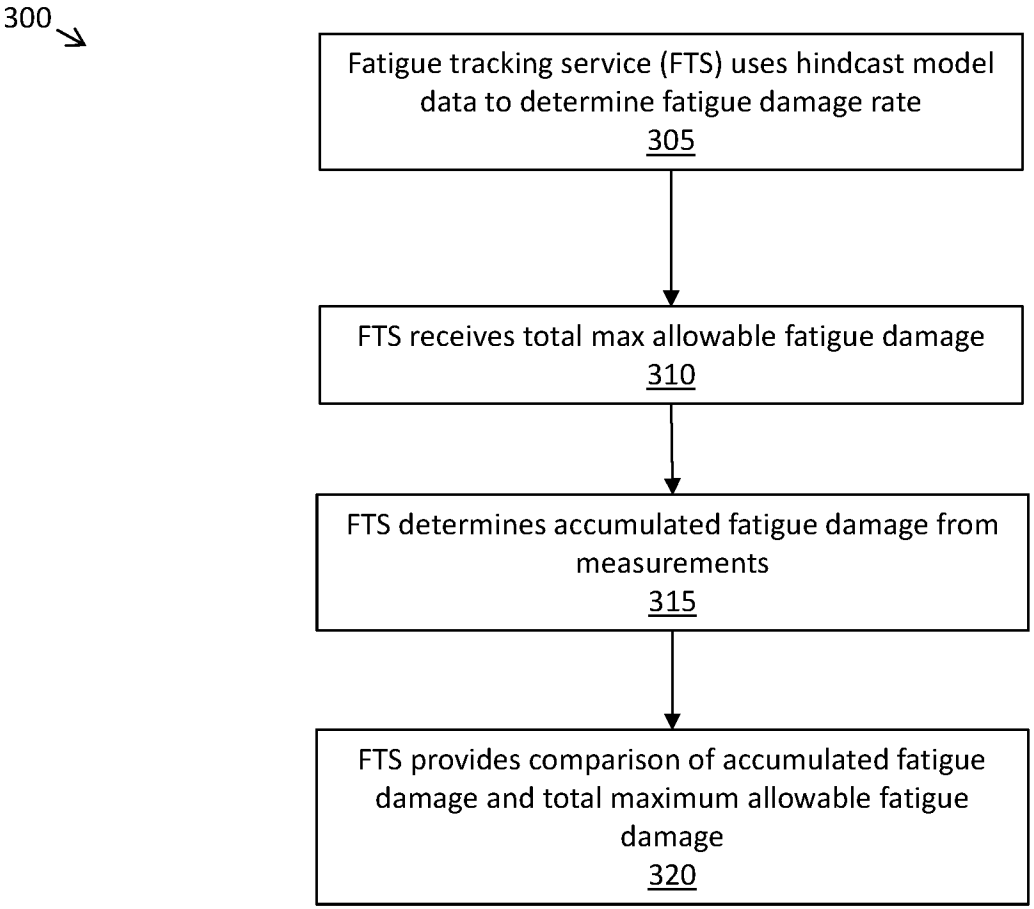
FIG. 3 is a flowchart illustrating an example method for monitoring wellhead fatigue damage in accordance with an example embodiment of the disclosure.
Figure 4:
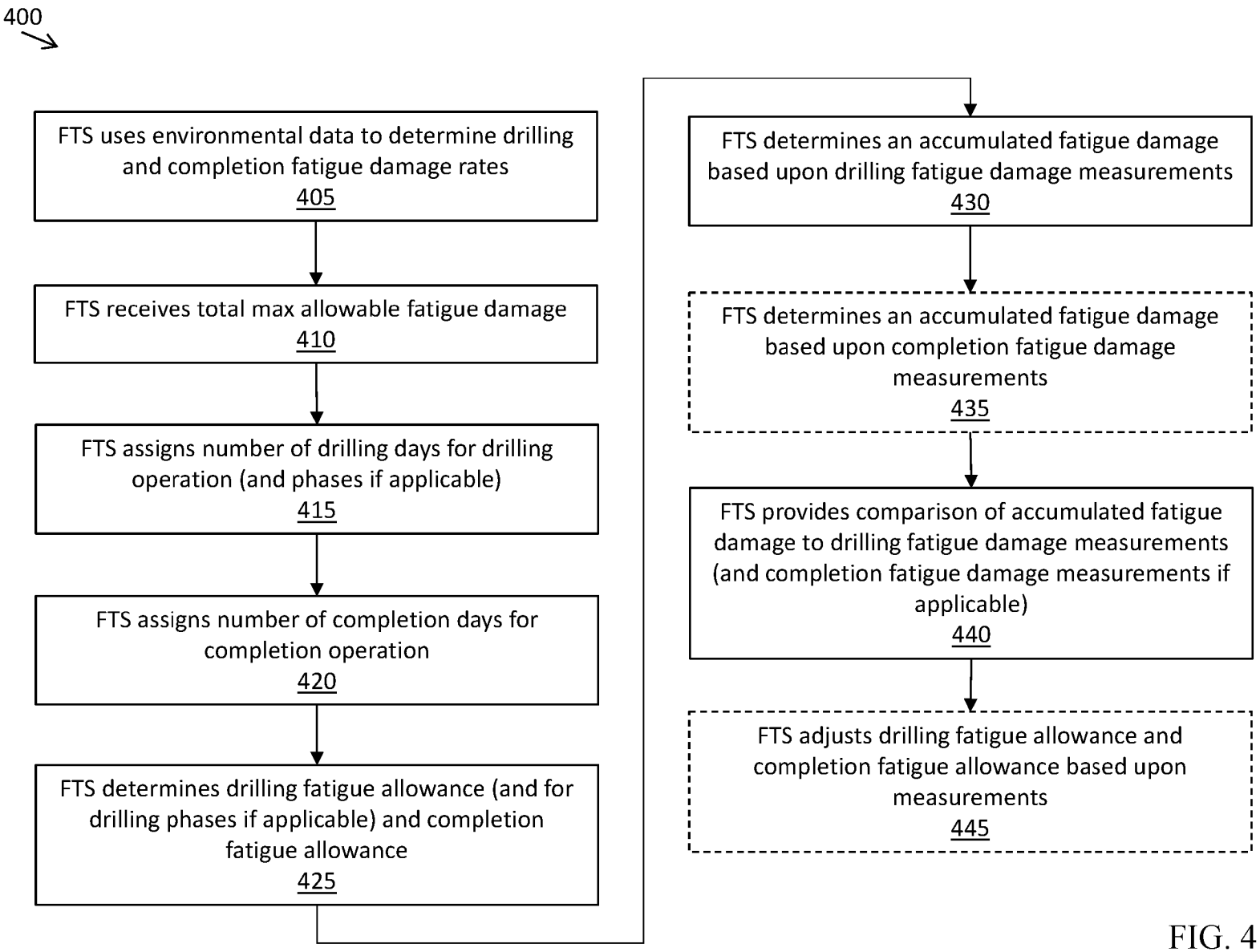
FIG. 4 is a flowchart illustrating in further detail an example method for monitoring wellhead fatigue in accordance with an example embodiment of the disclosure.

FIG. 3 is a flowchart illustrating an example method 300 for monitoring wellhead fatigue damage in accordance with an example embodiment of the disclosure. FIG. 4, which is described further below, illustrates another more detailed example method 400 for monitoring wellhead fatigue damage. Example method 300 of FIG. 3 illustrates use of the FTS 130 for monitoring wellhead fatigue. In alternate example embodiments, one or more of the operations illustrated in FIG. 3 could be performed in parallel, performed a different sequence, or eliminated. Furthermore, in alternate embodiments, other operations may be added to the method of FIG. 3.

Beginning with operation 305, the FTS 130 uses hindcast model data, or environmental data, to determine one or more fatigue damage rates. The hindcast model data describes typical conditions in the area of the well and can include one or more of ocean current data including current speed and current direction, wind data including wind speed and wind direction and wave data including wave speed and wave direction. The FTS 130 uses the hindcast model data to model the conditions that are likely to be encountered during the life of the well. The hindcast model data are used to estimate the forces to which the well system will be subjected and the resulting stress on the wellhead system. Tools known in the industry for use in estimating fatigue damage rates, such as finite element analysis methods can be used in determining fatigue damage rates for the wellhead system based on hindcast model data The FTS 130 can calculate fatigue damage rates for one or more particular operations associated with the well, including drilling of the well, completion of the well, intervention operations associated with the well, and other operations, if applicable, during the entire life cycle of the well. As will be described further below in connection with FIG. 4, the FTS also can take a more granular approach in which it calculates fatigue damage rates for various phases of each operation.

In operation 310, the FTS 130 receives a total maximum allowable fatigue damage that the wellhead system can sustain during its or the well's entire life cycle. For example, the wellhead system will have an estimated failure point at which the amount of accumulated fatigue damage at one or more locations on the components of the wellhead system causes the wellhead system to begin to fail. Using the failure point as a reference, the operator of the well can determine what percentage of accumulated wellhead fatigue damage is within acceptable risk parameters. For example, the operator may determine that limiting accumulated fatigue damage to 70% of the failure point for the wellhead system provides a sufficient buffer for operating the well. The 70% value will be treated as the total maximum amount of fatigue damage allowance that the wellhead system can sustain and still be operated within acceptable risk parameters. The operator can provide the total maximum allowable fatigue damage to the FTS 130 or the FTS 130 can calculate the value based upon the operator's parameters.

In operation 315, once the one or more operations commence on the well system, the FTS 130 can receive measurement data providing an indication of a fatigue damage rate, and subsequently the amount of fatigue damage, to the wellhead system. As described previously in connection with FIGS. 1 and 2, the source of the measurement data can be sensors located along the riser and/or on the subsea stack. The sensors can detect motion as well as linear and angular displacement of well system components and this data can be used to determine fatigue damage rates, and subsequently the amount of fatigue damage, to the wellhead system. Over time, the FTS 130 can continue to receive measurement data and can calculate an accumulated fatigue damage to the wellhead system.

In operation 320, the FTS 130 can compare the allowable fatigue damage from operation 310 to the accumulated fatigue damage from operation 315. The FTS 130 can generate a report, such as a data plot or a table, illustrating the comparison of allowable fatigue damage to accumulated fatigue damage to determine whether the accumulated fatigue damage from operations being performed on the well system is approaching the allowable fatigue damage. The report can be useful to operators of the wellhead system to ensure that the operations do not result in exceeding the allowable fatigue damage. Additionally, the report can be used to adjust planning and operations relating to the well system. For example, if a metocean condition or a weather system is approaching that may result in increases to the accumulated fatigue damage during an operation, the operator may choose to delay the operation or disconnect equipment from the well if the accumulated fatigue damage is approaching the allowable fatigue damage. Alternatively, if the comparison indicates the accumulated fatigue damage is well below the allowable fatigue damage, this buffer can provide the operator with greater flexibility in planning operations on the well.

Referring now to FIG. 4, a flowchart is provided illustrating an example of a more detailed method 400 for monitoring wellhead system fatigue damage in accordance with an example embodiment of the disclosure. Example method 400 illustrates use of the FTS 130 for monitoring wellhead system fatigue. In alternate example embodiments, one or more of the operations illustrated in FIG. 4 could be performed in parallel, performed in a different sequence, or eliminated. Furthermore, in alternate embodiments, other operations may be added to the method of FIG. 4.

Figure 8:
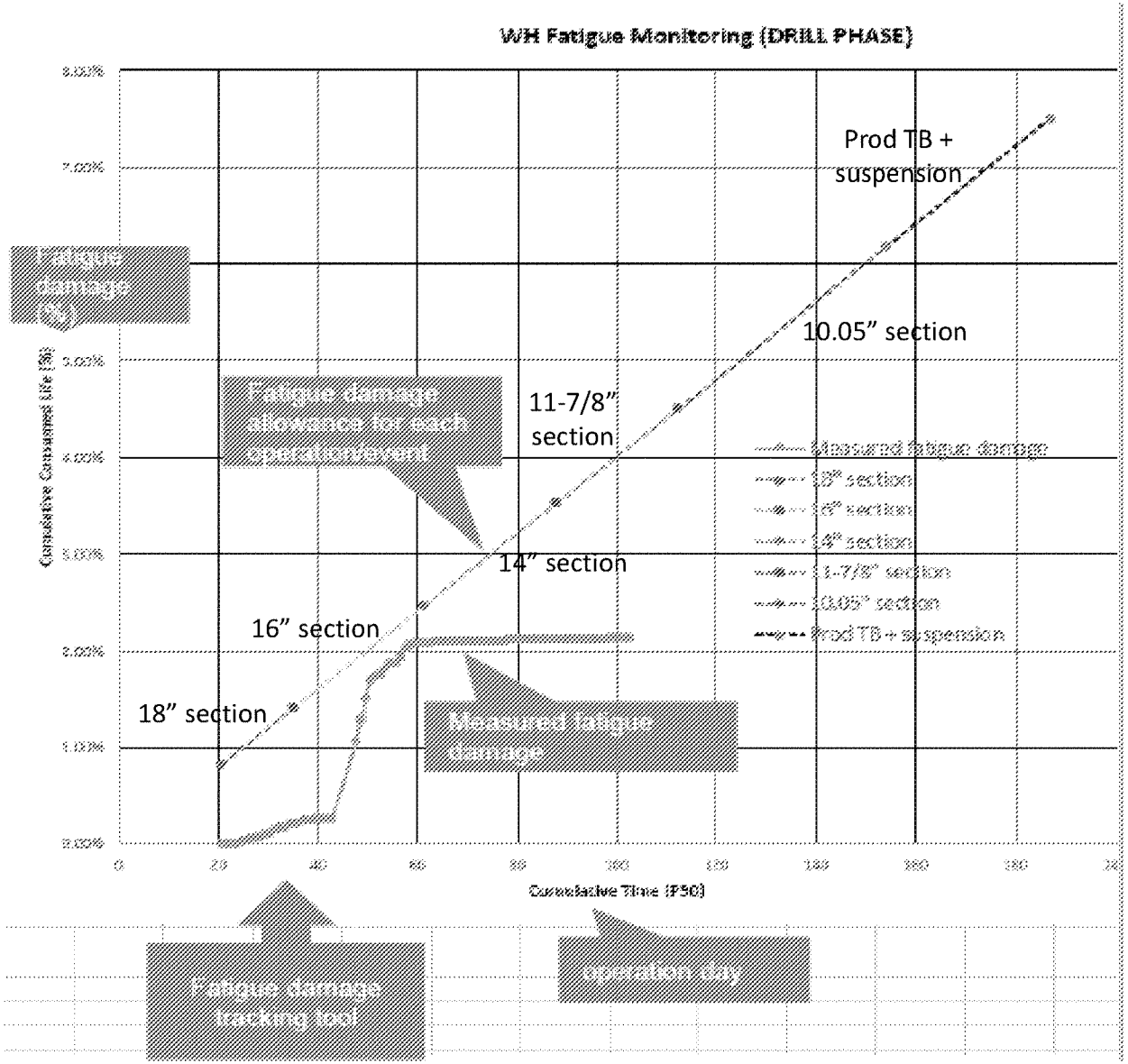
FIG. 8 illustrates a data plot comparing fatigue damage allowance to measured fatigue damage data in accordance with an example embodiment of the disclosure.

FIG. 4 will also be described with reference to FIGS. 5, 6, 7, and 8. FIGS. 5, 6, and 7 illustrate example data structures containing sample data associated with monitoring wellhead fatigue. The data illustrated in FIGS. 5, 6, and 7 can be collected and stored in the fatigue tracking database 140 illustrated in FIG. 2. The data illustrated in FIGS. 5 and 6 includes estimates for operating days and fatigue damage rates as well as calculated fatigue damage allowances. The estimates and calculations of FIGS. 5 and 6 can apply to a single well or to multiple wells in a field. In contrast, the data illustrated in FIG. 7 are measurements of fatigue damage to a specific wellhead system based upon measurements gathered from sensors on a well system. Lastly, FIG. 8 illustrates a data plot comparing fatigue damage allowance to measured fatigue damage data for a wellhead system. The example data structures illustrated in FIGS. 5, 6, and 7 are merely illustrative and in other embodiments other data structures having greater or fewer data elements can be implemented. For example, in other embodiments, there may be greater or fewer drilling phases for the drilling operation. Similarly, in other embodiments, if intervention operations are not expected to contribute materially to the accumulated fatigue damage of the wellhead, the intervention operations could be eliminated. In yet other embodiments, there may be other operations added to the fatigue damage analysis.

Beginning with operation 405 of FIG. 4, the FTS 130 uses historical environmental data for the environment of the well system, or hindcast model data, to determine a fatigue damage rate for drilling operations and for completion operations and, if applicable, other operations. Similar to operation 305 of FIG. 3, in operation 405 the FTS 130 can use one or more of ocean current data and wave data to estimate a drilling fatigue damage rate and a completion fatigue damage rate and, if applicable, a fatigue damage rate for other operations. As explained previously, tools known in the industry for use in estimating fatigue damage rates, such as finite element analysis, can be used in determining fatigue damage rates for the wellhead system. FIG. 6 illustrates examples of a drilling fatigue damage rate of 0.005% per day and a completion fatigue damage rate of 0.083% per day. As indicated by the relative rates, the wellhead system is typically subjected to greater stresses during a completion operation relative to a drilling operation due to the moment arm of the subsea stack equipment that extends vertically from the wellhead system causing higher stress on the wellhead system during the completion operation. In an alternate embodiment, the FTS 130 also can determine an intervention fatigue damage rate for intervention operations, such as a workover operation, or an abandonment fatigue damage rate for an abandonment operation. FIG. 6 provides an example of an intervention fatigue damage rate of 0.000% for an intervention operation because the wellhead system typically experiences little stress during intervention operations.

In operation 410, the FTS 130 receives a total maximum allowable fatigue damage value for the wellhead system during it entire life cycle. Similar to operation 310, the total maximum allowable fatigue damage can be a percentage of the estimated failure point for one or more locations on the components of the wellhead system and can be set by an operator of the well or can be calculated by the FTS 130. In the example data of FIG. 6, the total maximum allowable fatigue damage is set at 70%.

In operations 415 and 420, the FTS 130 assigns a number of drilling days, or operating days of drilling, for the drilling operation as well as a number of completion days, or operating days of completion work, for the completion operation. The number of drilling days and number of completion days can be based on historical data for similar wells and/or the work plan for the particular well that is to be drilled and completed. The example data in FIGS. 5 and 6 includes 187 as the number of drilling days and 377 as the number of completion days. The example data of FIG. 5 also subdivides the number of drilling days based on phases of the drilling. The drilling operation typically includes multiple steps or phases, such as installation of the blow out preventor and drilling successive sections of the well beginning with larger diameter sections, such as an 18 inch liner section, and successively drilling sections with progressively smaller diameters. In the example of FIG. 5, the 187 drilling days are subdivided so that 20.6 days are assigned for the first drilling phase for installing the blow out preventor, 14.4 days are assigned for the second drilling phase for drilling the 18 inch liner section of the well, and so forth. The activities and sections of the well provided in FIG. 5 are merely illustrative and a similar method can be applied to other wells involving different activities or different dimensions. In alternate embodiments, a number of days can be assigned to other operations, such as 23.2 days assigned to intervention operations in the example data of FIG. 5.

The number of drilling days and the number of completion days are projected estimates. In the example data of FIGS. 5 and 6, the worst case scenario for the projected estimates of operating days is used as indicated by P90. The FTS 130 also can assign operating days based on other scenarios, such as P10 and P50, that are more optimistic and that estimate fewer operating days will be required as compared to the P90 scenario. The number of drilling days, the number of completion days, the number of intervention operation days, and other related data for different scenarios can be stored as data referred to as well construction days in the fatigue tracking database 140. The data associated with these scenarios can be used to update the operating days projections and fatigue allowance as the construction and operation of the well proceeds and actual data about the well becomes available.

In operation 425, the FTS 130 determines a drilling fatigue allowance and a completion fatigue allowance based upon the drilling fatigue damage rate, the completion fatigue damage rate, the total maximum allowable fatigue damage, the number of drilling days, and the number of completion days. In the example of FIG. 6, the FTS 130 determines a drilling fatigue damage of 1.01% by multiplying the drilling fatigue damage rate by the number of drilling days. Similarly, a completion fatigue damage of 31.28% is determined by multiplying the completion fatigue damage rate by the number of completion days. Lastly, the FTS 130 subdivides the total maximum allowable fatigue damage in proportion to the damage that will be incurred during each of the well operations so that portions are assigned for the drilling operation and for the completion operation based on the number of planned operating days. In the example of FIG. 6, the 70% total maximum allowable fatigue damage is subdivided in rough proportion to the amount of fatigue damage that is expected to occur during each operation resulting in 7.50% for the drilling fatigue allowance and 60.00% for the completion fatigue allowance. The example of FIG. 6 also includes an allowance of 2.50% for the intervention operation fatigue allowance.

As indicated in the example data of FIG. 5, fatigue allowance for any operation can be subdivided according to the phases of that operation in proportion to the number of operating days for each of those phases. In FIG. 5, the 7.50% drilling fatigue allowance is subdivided among the several drilling phases so that a fatigue allowance of 0.83% is assigned for the first drilling phase involving installation of the blow out preventor and a fatigue allowance of 0.58% is assigned for the second drilling phase involving drilling of the 18 inch diameter section of the well.

The FTS 130 can determine drilling fatigue allowance and completion fatigue allowance for a variety of scenarios. For example, depending on the various engineering challenges that may be encountered during the drilling operation or the completion operation, different well system equipment may be employed that may result in different stresses on the wellhead system. Similarly, the phases of the drilling operation may vary resulting in an actual number of operating days that differs from the estimated projections. The FTS 130 can store these various scenarios in the fatigue tracking database 140 for adjusting fatigue allowance and well construction planning during the drilling and completion operations.

In operation 430, the FTS 130 receives drilling fatigue damage measurements from the sensors, such as accelerometers and/or strain gauges and/or an inclinometer, on the well system equipment and determines an accumulated fatigue damage for the wellhead system. FIG. 7 illustrates an example of data associated with the drilling fatigue damage measurements. The left two columns in FIG. 7 show the dates the data was collected from the sensors and a running total of the operating days. The third column from the left shows the amount of fatigue damage incurred on the day shown in the first column from the left on the wellhead system at the location 7 feet above the mudline ("AML"). The fourth column shows a running total of the accumulated fatigue damage incurred by the wellhead system. The row corresponding to 1/5/2022 shows that on operating day 32.6 the 18 inch liner section drilling phase of the drilling operation was completed and the measurement data indicates that 0.167% of accumulated fatigue damage had been incurred at the wellhead system, at the location of 7 feet above the mudline. The FTS 130 can compare this data to the projections in FIG. 5 to provide insights for managing the accumulated fatigue damage incurred by the wellhead. The projections in FIG. 5 estimated that the 18 inch liner section of the drilling phase would be completed at 35.0 operating days and the cumulative fatigue damage allowance for that phase of the drilling operations was 1.40%. The actual measurement data provided in FIG. 7 shows that the 18 inch diameter section of the drilling phase was completed 2.4 operating days ahead of schedule and 1.233% (1.40% minus 0.167%) less cumulative fatigue damage was incurred by the wellhead system. Therefore, the comparison indicates that the drilling operation is proceeding within the fatigue damage allowance.

Similar to operation 430 but for the subsequent completion operation, operation 435 indicates that the FTS 130 can determine an accumulated fatigue damage based upon completion fatigue damage measurements from sensors on the well system equipment. As described in operation 430, the FTS 130 can compare the completion fatigue damage measurements to the projected completion data for completion days and completion fatigue allowance to determine whether the completion operation is proceeding within the projected estimates. If the work has not yet reached the completion operation, the FTS 130 would skip operation 435 and proceed to operation 440. As another optional step, the FTS can determine the accumulated fatigue damage from measurements of other operations, such as intervention operations.

In operation 440, the FTS 130 can provide one or more reports illustrating the comparison between the fatigue damage measurements, such as those illustrated in FIG. 7, and the estimated projections, such as those illustrated in FIG. 5. The reports can take a variety of forms, including tables and graphical data plots. FIG. 8 provides one example of such a report in the form of a graphical data plot. Using the example data provided in FIG. 5, FIG. 8 shows the fatigue damage allowance for each phase of the drilling operation plotted as a function of cumulative days. Beginning with the example data provided in FIG. 7 for days 20.6 through 33.6 and then continuing beyond day 100, FIG. 8 also shows a plot of the accumulated (measured) fatigue damage for the wellhead system based upon the measurement data received from the well system sensors. Unlike the linear progression of the fatigue damage allowance, the accumulated (measured) fatigue damage is well below the fatigue damage allowance during days 20 through 40, but the rate of accumulated (measured) fatigue damage increases substantially between days 45 through 50. During days 60 through 100 the accumulated (measured) fatigue damage is essentially unchanged.

In operation 445, the FTS 130 can use the comparison illustrated in FIG. 8 to adjust the fatigue allowance for subsequent operations. For example, as illustrated in FIG. 8, at day 105 the accumulated (measured) fatigue damage is substantially lower than the fatigue damage allowance at the drilling phase for the 11-⅞" liner section of the drilling operation. The substantially lower accumulated (measured) fatigue damage provides an opportunity to increase the fatigue damage allowance for subsequent phases or operations and remains below the 70% total fatigue damage allowance. Additionally, the comparison provides the well operator with flexibility in planning operations relating to the well. For example, operations may be able to continue during periods of higher winds or faster ocean currents because accumulated (measured) fatigue damage to the wellhead system is less severe than projected. Accordingly, the FTS 130 provides the well operator with several advantages in managing the operations of the well. Operation 445 is shown in broken lines because in alternate embodiments it may not be performed, it may be performed at another time, or it may be performed manually by the well operator.

General Information Regarding Computing Systems

As described in connection with FIGS. 1-8, some or all of the processing operations described in connection with the foregoing systems and methods can be performed by computing systems such as a personal computer, a desktop computer, a computer server, or cloud computing systems. As explained previously, certain operations of the foregoing methods can be performed by a combination of computing systems.

The computing systems used in the foregoing embodiments can include typical components such as one or more processors, memories, input/output devices, and a storage devices. The components of the computing systems can be interconnected, for example, by a system bus or by communication links. The components of the previously described computing systems are not exhaustive.

The one or more processors can be one or more hardware processors and can execute computer-readable instructions, such as instructions stored in a memory. The processor can be an integrated circuit, a central processing unit, a multi-core processing chip, an SoC, a multi-chip module including multiple multi-core processing chips, or other hardware processor in one or more example embodiments. The hardware processor is known by other names, including but not limited to a computer processor, a microprocessor, and a multi-core processor.

The memory can store information including computer-readable instructions and data. The memory can be cache memory, a main memory, and/or any other suitable type of memory. The memory is a non-transitory computer-readable medium. In some cases, the memory can be a volatile memory device, while in other cases the memory can be a non-volatile memory device.

The storage device can be a non-transitory computer-readable medium that provides large capacity storage for a computing system. The storage device can be a disk drive, a flash drive, a solid state device, or some other type of storage device. In some cases, the storage device can be a database that is remote from the computing system. The storage device can store operating system data, file data, database data, algorithms, and software modules, as examples.

Assumptions and Definitions

For any figure shown and described herein, one or more of the components may be omitted, added, repeated, and/or substituted. Accordingly, embodiments shown in a particular figure should not be considered limited to the specific arrangements of components shown in such figure. Further, if a component of a figure is described but not expressly shown or labeled in that figure, the label used for a corresponding component in another figure can be inferred to that component. Conversely, if a component in a figure is labeled but not described the description for such component can be substantially the same as the description for the corresponding component in another figure.

With respect to the example methods described herein, in alternate embodiments, certain steps of the methods may be performed in a different order, may be performed in parallel, or may be omitted. Moreover, in alternate embodiments additional steps may be added to the example methods described herein. Accordingly, the example methods provided herein should be viewed as illustrative and not limiting of the disclosure.

Terms such as "first" and "second" are used merely to distinguish one element (or state of an element) from another. Such terms are not meant to denote a preference and are not meant to limit the embodiments described herein. In the example embodiments described herein, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The terms "a," "an," and "the" are intended to include plural alternatives, e.g., at least one. The terms "including", "with", and "having", as used herein, are defined as comprising (i.e., open language), unless specified otherwise.

Values, ranges, or features may be expressed herein as "about", from "about" one particular value, and/or to "about" another particular value. When such values, or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed therein, and that each value is also herein disclosed as "about" that particular value in addition to the value itself. In another aspect, use of the term "about" means±20% of the stated value, ±15% of the stated value, ±10% of the stated value, ±5% of the stated value, ±3% of the stated value, or ±1% of the stated value.

Although embodiments described herein are made with reference to example embodiments, it should be appreciated by those skilled in the art that various modifications are well within the scope of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A computing system comprising:

a processor;

a memory; and a storage device comprising a fatigue tracking service, the fatigue tracking service comprising computer-executable instructions that perform a method comprising:

obtaining, from a database in communication with the storage device, historical environmental data for an environment in which a wellhead system is located, the historical environmental data including one or more of ocean current data, wind data, and wave data;

transforming the historical environmental data into a fatigue damage rate for the wellhead system, the fatigue damage rate comprising a drilling fatigue damage rate for a drilling operation and a completion fatigue damage rate for a completion operation;

receiving a total maximum allowable fatigue damage for the wellhead system;

assigning a number of drilling days for the drilling operation and a number of completion days for the completion operation;

determining a drilling fatigue allowance and a completion fatigue allowance based upon the drilling fatigue damage rate, the completion fatigue damage rate, the total maximum allowable fatigue damage, the number of drilling days, and the number of completion days;

determining an accumulated fatigue damage for the wellhead system based upon at least one of drilling fatigue damage measurements for the wellhead system and completion fatigue damage measurements for the wellhead system, wherein at least one of the drilling fatigue damage measurements and the completion fatigue damage measurements are received from one or more sensors located on at least one of a slick joint and a subsea stack coupled to the wellhead system;

storing the drilling fatigue allowance, the completion fatigue allowance, and the accumulated fatigue damage in the database in communication with the storage device; and generating a graphical comparison of the accumulated fatigue damage to at least one of the drilling fatigue allowance and the completion fatigue allowance, wherein, responsive to the graphical comparison, monitoring is performed on one or more locations of highest risk of fatigue damage on the wellhead system.

2. The computing system of claim 1, wherein the method further comprises:

adjusting the completion fatigue allowance and the completion operation for the wellhead system based upon the drilling fatigue damage measurements diverging from the drilling fatigue allowance.

3. The computing system of claim 1, wherein the fatigue tracking service is a machine learning model that is trained on historical fatigue damage data and the historical environmental data to predict the fatigue damage rate for the wellhead system.

4. The computing system of claim 3, wherein:

the drilling operation comprises a first drilling phase associated with a first drilling phase number of days and a second drilling phase associated with a second drilling phase number of days;

wherein the accumulated fatigue damage for the wellhead system is based upon a first drilling phase fatigue damage measurement, and wherein the method further comprises adjusting at least one of the drilling fatigue allowance and the completion fatigue allowance based upon the first drilling phase fatigue damage measurement.

5. The computing system of claim 4, wherein the fatigue damage rate further comprises an abandonment fatigue damage rate for an abandonment operation.

6. The computing system of claim 1, wherein the fatigue damage rate further comprises an intervention fatigue damage rate for an intervention operation and wherein the method further comprises:

assigning a number of intervention days for the intervention operation;

determining an intervention fatigue allowance based upon the intervention fatigue damage rate and the number of intervention days;

determining the accumulated fatigue damage for the wellhead system by including intervention fatigue damage measurements for the wellhead system; and providing a comparison of the accumulated fatigue damage to the intervention fatigue allowance.

7. The computing system of claim 6, wherein the method further comprises:

adjusting the intervention fatigue allowance rate based upon at least one of the drilling fatigue damage measurements, the completion fatigue damage measurements, and the intervention fatigue damage measurements.

8. A computer-implemented method for monitoring fatigue damage to a wellhead system, the method comprising:

obtaining, from a database, historical environmental data for an environment in which a wellhead system is located, the historical environmental data including one or more of ocean current data, wind data, and wave data;

transforming, by a fatigue tracking service, the historical environmental data into a fatigue damage rate for the wellhead system, the fatigue damage rate comprising a drilling fatigue damage rate for a drilling operation and a completion fatigue damage rate for a completion operation;

receiving a total maximum allowable fatigue damage for the wellhead system;

assigning a number of drilling days for the drilling operation and a number of completion days for the completion operation;

determining a drilling fatigue allowance and a completion fatigue allowance based upon the drilling fatigue damage rate, the completion fatigue damage rate, the total maximum allowable fatigue damage, the number of drilling days, and the number of completion days;

determining an accumulated fatigue damage for the wellhead system based upon at least one of drilling fatigue damage measurements for the wellhead system and completion fatigue damage measurements for the wellhead system, wherein at least one of the drilling fatigue damage measurements and the completion fatigue damage measurements are received from one or more sensors located on at least one of a slick joint and a subsea stack coupled to the wellhead system;

storing the drilling fatigue allowance, the completion fatigue allowance, and the accumulated fatigue damage in the database; and generating a graphical comparison of the accumulated fatigue damage to at least one of the drilling fatigue allowance and the completion fatigue allowance, wherein, responsive to the graphical comparison, monitoring is performed on one or more locations of highest risk of fatigue damage on the wellhead system.

9. The method of claim 8, wherein the method further comprises:

adjusting the completion fatigue allowance and the completion operation for the wellhead system based upon the drilling fatigue damage measurements diverging from the drilling fatigue allowance.

10. The method of claim 8, wherein the fatigue tracking service is a machine learning model that is trained on historical fatigue damage data and the historical environmental data to predict the fatigue damage rate for the wellhead system.

11. The method of claim 10, wherein:

the drilling operation comprises a first drilling phase associated with a first drilling phase number of days and a second drilling phase associated with a second drilling phase number of days;

wherein the accumulated fatigue damage for the wellhead system is based upon a first drilling phase fatigue damage measurement, and wherein the method further comprises adjusting at least one of the drilling fatigue allowance and the completion fatigue allowance based upon the first drilling phase fatigue damage measurement.

12. The method of claim 11, wherein the fatigue damage rate further comprises an abandonment fatigue damage rate for an abandonment operation.

13. The method of claim 8, wherein the fatigue damage rate further comprises an intervention fatigue damage rate for an intervention operation and wherein the method further comprises:

assigning a number of intervention days for the intervention operation;

determining an intervention fatigue allowance based upon the intervention fatigue damage rate and the number of intervention days;

determining the accumulated fatigue damage for the wellhead by including intervention fatigue damage measurements for the wellhead system; and providing a comparison of the accumulated fatigue damage to the intervention fatigue allowance.

14. The method of claim 13, further comprising:

adjusting the intervention fatigue allowance rate based upon at least one of the drilling fatigue damage measurements, the completion fatigue damage measurements, and the intervention fatigue damage measurements.

15. A non-transitory computer-readable medium comprising computer-executable instructions that when executed by a hardware processor perform a method comprising:

obtaining, from a database, historical environmental data for an environment in which a wellhead system is located, the historical environmental data including one or more of ocean current data, wind data, and wave data;

transforming, by a fatigue tracking service, the historical environmental data into a fatigue damage rate for the wellhead system, the fatigue damage rate comprising a drilling fatigue damage rate for a drilling operation and a completion fatigue damage rate for a completion operation;

receiving a total maximum allowable fatigue damage for the wellhead system;

assigning a number of drilling days for the drilling operation and a number of completion days for the completion operation;

determining a drilling fatigue allowance and a completion fatigue allowance based upon the drilling fatigue damage rate, the completion fatigue damage rate, the total maximum allowable fatigue damage, the number of drilling days, and the number of completion days;

determining an accumulated fatigue damage for the wellhead system based upon at least one of drilling fatigue damage measurements for the wellhead system and completion fatigue damage measurements for the wellhead system, wherein at least one of the drilling fatigue damage measurements and the completion fatigue damage measurements are received from one or more sensors located on at least one of a slick joint and a subsea stack coupled to the wellhead system;

storing the drilling fatigue allowance, the completion fatigue allowance, and the accumulated fatigue damage in the database; and generating a graphical comparison of the accumulated fatigue damage to at least one of the drilling fatigue allowance and the completion fatigue allowance, wherein, responsive to the graphical comparison, monitoring is performed on one or more locations of highest risk of fatigue damage on the wellhead system.

16. The non-transitory computer-readable medium of claim 15, wherein the method further comprises:

adjusting the completion fatigue allowance and the completion operation for the wellhead system based upon the drilling fatigue damage measurements diverging from the drilling fatigue allowance.

17. The non-transitory computer-readable medium of claim 15, wherein the fatigue tracking service is a machine learning model that is trained on historical fatigue damage data and the historical environmental data to predict the fatigue damage rate for the wellhead system.

18. The non-transitory computer-readable medium of claim 17, wherein:

The drilling operation comprises a first drilling phase associated with a first drilling phase number of days and a second drilling phase associated with a second drilling phase number of days;

wherein the accumulated fatigue damage for the wellhead system is based upon a first drilling phase fatigue damage measurement, and wherein the method further comprises adjusting at least one of the drilling fatigue allowance and the completion fatigue allowance based upon the first drilling phase fatigue damage measurement.

19. The non-transitory computer-readable medium of claim 18, wherein the fatigue damage rate further comprises an abandonment fatigue damage rate for an abandonment operation.

20. The non-transitory computer-readable medium of claim 15, wherein the fatigue damage rate further comprises an intervention fatigue damage rate for an intervention operation and wherein the method further comprises:

assigning a number of intervention days for the intervention operation;

determining an intervention fatigue allowance based upon the intervention fatigue damage rate and the number of intervention days;

determining the accumulated fatigue damage for the wellhead system by including intervention fatigue damage measurements for the wellhead; and providing a comparison of the accumulated fatigue damage to the intervention fatigue allowance.

* * * * *